US008887348B2

(12) United States Patent
Kenter et al.

(10) Patent No.: US 8,887,348 B2
(45) Date of Patent: Nov. 18, 2014

(54) HANDHELD FLOOR TREATMENT DEVICE

(75) Inventors: Rainer Kenter, Leipheim (DE); Rudolf Franke, Bensheim (DE)

(73) Assignee: i-mop GmbH, Bensheim (DE)

( * ) Notice: Subject to any disclaimer, the term of this patent is extended or adjusted under 35 U.S.C. 154(b) by 334 days.

(21) Appl. No.: 13/392,122

(22) PCT Filed: Aug. 25, 2010

(86) PCT No.: PCT/DE2010/000987

§ 371 (c)(1),
(2), (4) Date: May 7, 2012

(87) PCT Pub. No.: WO2011/023169

PCT Pub. Date: Mar. 3, 2011

(65) Prior Publication Data

US 2012/0279010 A1 Nov. 8, 2012

(30) Foreign Application Priority Data

Aug. 27, 2009 (DE) ..... 10 2009 028 944

(51) Int. Cl.

| | |
|---|---|
| ***A47L 11/292*** | (2006.01) |
| ***A47L 7/02*** | (2006.01) |
| ***A47L 11/30*** | (2006.01) |
| ***A47L 11/20*** | (2006.01) |
| ***A47L 11/40*** | (2006.01) |
| ***B24B 7/18*** | (2006.01) |
| ***B24B 55/12*** | (2006.01) |
| ***A47L 11/16*** | (2006.01) |

(52) U.S. Cl.

CPC ..... *A47L 11/40* (2013.01); *A47L 11/4075* (2013.01); *A47L 11/4013* (2013.01); *B24B 7/18* (2013.01); *A47L 11/305* (2013.01); *B24B 55/12* (2013.01); *A47L 11/161* (2013.01)

USPC ..... 15/320; 15/50.1; 15/98

(58) Field of Classification Search

USPC ..... 15/98, 340.2, 340.3, 22.1, 49.1, 97.1, 15/41.1, 50.1, 22.2, 48.1, 79.1, 79.2, 15/144.2, 415.1, 320; 451/350, 353, 359

See application file for complete search history.

(56) References Cited

U.S. PATENT DOCUMENTS

| | | | | |
|---|---|---|---|---|
| 3,778,860 | A * | 12/1973 | Thielen | 15/147.2 |
| 5,596,787 | A * | 1/1997 | Stevens et al. | 15/220.1 |
| 6,783,600 | B2 * | 8/2004 | Tawara et al. | 134/6 |
| 7,552,499 | B2 * | 6/2009 | James et al. | 15/144.2 |
| 7,770,254 | B2 * | 8/2010 | Alexander | 15/321 |
| 8,161,595 | B1 * | 4/2012 | Wilson | 15/320 |

* cited by examiner

*Primary Examiner* — Dung Van Nguyen
(74) *Attorney, Agent, or Firm* — Foley Hoag LLP

(57) ABSTRACT

The invention relates to a handheld floor treatment device, comprising a floor part (1), which has a liquid supply (11), and a liquid in-take (13) and a structurally separated suction unit that contains at least one suction turbine (17). The invention further relates to a handheld floor treatment device, comprising a floor part (1) having a bow (5), which encompasses the floor part (1) at least in some sections and which is connected to the floor part (1) by means of a first joint (4) that can be adjusted in the treatment direction (6), and further comprising a guide part (2) attached to the bow (5), the guide part having a handle (3). The guide part (2) comprises a further joint (8) at the lower end below the center but above the floor part (1), about which joint the guide part (2) can be adjusted transversely to the treatment direction (6) so that the floor part (1) can be rotated by a user (P) parallel to the treatment surface (B) about a vertical axis (A1) of the floor part (1) by at least ±45°, even if the guide part (2) is in a tilted position.

18 Claims, 5 Drawing Sheets

HANDHELD FLOOR TREATMENT DEVICE

CROSS-REFERENCE TO RELATED APPLICATIONS

This application is the U.S. National Stage Application of International Application No. PCT/DE2010/000987, filed on Aug. 25, 2010, which claims the benefit of priority to Germany Application No. 10 2009 028 944.5, filed on Aug. 27, 2009, the entire contents of which are expressly incorporated in their entirety.

TECHNICAL FIELD

The invention concerns a hand-guided floor cleaning machine that cleans floors by scrubbing, polishing or buffing.

PRIOR ART

An apparatus for treatment of surfaces is known from EP 0 978 249, especially for cleaning and polishing, which provides an articulation movable in at least two directions between a holding device and the bottom part. This articulation enables the user to adapt the gripping height to the personal height of the user by oblique positioning of the holding device and to move the apparatus back and forth in the cleaning direction, as well as perform lateral movements with the device.

Since the articulation is arranged laterally on the bottom part and the bottom part has protruding parts, lateral mobility, however, is restricted.

A steam scrubbing machine with a handle part movable relative to the bottom part is known from DE 203 02 630 U1, which has a water tank, a water pump, a heater and a steam distributor on the bottom part. A vacuum cleaner unit, comprising a suction space, a suction pump, a suction channel and a suction opening, also mounted on the bottom part, is disclosed as an advantageous modification for dry cleaning.

Backpack vacuum cleaners with a backpack unit and a support frame are also known, in which the backpack unit includes at least one suction pump and a suction space. An energy storage device for power supply to the pump can also be provided in the backpack unit to increase mobility.

DE 196 22 856 A1 discloses a surface scrubber guided by hand, which has at least one, preferably two disk brushes, as well as at least one roller brush, and which is supported on wheels. A squeegee is also provided, which is preferably mounted on the back end of the cleaning device and which is connected to a receiving container for dirty water via a hose. A container for the cleaning liquid is also mounted on the surface scrubber.

The surface scrubber, however, has the drawback that its weight is increased by the liquid container mounted on the device itself and that the wheels do permit easy movement in a linear direction, but do not actually permit mobility in the lateral direction.

A lip for a wiping device is known from EP 0 560 523 A2, which has protrusions on one side surface along its length with nonprotruding spaces between the protrusions, which extend upward from the lower edge, the other side surface being smooth. If this lip is moved over a floor with its smooth side, a seal with the floor, which does not permit water to enter, is formed. If the lip is moved over the floor with the side surface having the protrusions, water can flow through the mentioned intermediate spaces. Because of this a suction unit consisting of two corresponding lips can take up water in two directions, forward and backward.

The underlying task of the invention is to provide a floor cleaning machine, which, in addition to polishing or buffing, also permits wet cleaning and is easily movable and operable by hand.

PRESENTATION OF THE INVENTION

The hand-guided floor cleaning machine according to the invention has a bottom part with at least one tool for floor cleaning and a motor to drive the at least one tool, as well as a guide part with a handle, the guide part being connected to an articulation axis across the direction of cleaning to the bottom part via a first articulation adjustable in the cleaning direction. The bottom part has a liquid feed and a liquid receptacle. A separate suction unit is also provided, which includes at least one suction turbine to take up liquid.

Design of the suction unit as a separate unit makes it possible to keep the weight of the bottom part and the guide part low and therefore to guarantee the easiest possible, resistance-free movement of the bottom part by means of the guide part. The separate suction unit according to the invention includes at least the suction turbine.

A container for the taken up liquid is advantageously arranged on the bottom part and/or on the guide part and is connected via a hose to the separate suction unit.

By design separation of the container for the taken up liquid from the suction turbine it can be ensured in simple fashion that the suction turbine does not come in contact with liquid. Provision of the container for the taken up liquid on the bottom part also has the advantage that the path for the water being taken up from the floor to the container for the taken up liquid is as short as possible so that the effective suction power of the suction turbine is increased.

The container for the taken up liquid is advantageously formed elongated along the guide part. The liquid in the container for the taken up liquid also remains on this account as close as possible to the guide part even when the guide part is positioned obliquely so that movement of the bottom part by means of the guide part is not needlessly hampered by the weight of the liquid.

The separate suction unit advantageously has a container for the taken up liquid. Because of this the bottom part and the guide part are not hampered by the weight of the taken up liquid and their mobility is not restricted on this account.

The container for the taken up liquid advantageously has an outlet opening and an outlet connector connected to the outlet opening or an outlet hose with a closure.

Because of this the liquid taken up with the suction unit can be discharged again. The closure should then be configured as simple as possible so that the dirt contained in the taken up liquid does not adversely affect the sealing capability of the closure. A large cover can also be provided, which permits rapid and simple emptying and also cleaning of the container for the taken up liquid.

The suction unit is advantageously designed as an additional bottom unit. An additional bottom unit, which has wheels, for example, and can be pulled behind the floor cleaning machine by means of a traction mechanism can be implemented simply and cost-effectively, since the size of a bottom unit is not very critical. A bottom unit need not be particularly small in order to pull it easily on wheels and in order not to significantly hamper the user during his work.

The suction unit is advantageously designed as a unit to be attached to the body of a user.

A unit to be fastened to the body only slightly restricts the user in his freedom of motion and permits easy mobility of the bottom part by means of the guide part owing to the lower weight of the bottom part and the guide part.

Depending on the weight and volume of the unit to be fastened to the body, the thing to do is to design this as a backpack unit or also provide a unit to be fastened around the hips or in front of the stomach.

The unit to be fastened to the body is advantageously provided with a support frame. Because of this the unit being fastened to the body can be comfortably worn by the user on the body. The support frame can be designed, for example, like the frame of a backpack so that the unit to be fastened to the body can be comfortably worn on the back. The outlet opening of the container arranged on the unit to be fastened to the body for the taken up liquid is advantageously arranged in the bottom area, the outlet connector or outlet hose with closure being arranged so that it is possible for the user to discharge the taken up liquid while he is wearing the unit to be fastened to the body.

Discharge of the taken up liquid while the user is still wearing the unit to be fastened to the body has the advantage that the unit fastened to the body need not be removed with the additional weight of the taken up water, which could be cumbersome. The unit being fastened to the body and designed, for example, as a backpack unit therefore need not be taken off with the additional weight, since the taken up water added has additional weight can be simply discharged again beforehand.

The bottom part is advantageously exclusively supported on the tool for floor cleaning.

This has the advantage that the mobility of the bottom part is not restricted by an extra support device with rollers. An additional support device can be dispensed with because of the limited weight of the bottom part and the guide part.

The floor cleaning machine advantageously has at least one energy storage device and/or power cable to an external power supply to supply the at least one tool for floor cleaning and/or the suction turbine.

An external power supply of the floor cleaning machine connected by means of a power cable has the advantage that the cleaning machine can be operated without an energy storage device mounted on the bottom part or guide part, which makes it possible to keep the weight of the bottom part and guide part very low so that the bottom part is very maneuverable and easily movable by means of the guide part. Connection to an external power supply also permits unlimited operating time of the floor cleaning machine.

An energy storage device makes it possible to operate the floor cleaning machine without connection to an external power supply and in so doing increases the movement radius of the floor cleaning machine. This permits cleaning of stairways with the floor cleaning machine according to the invention.

It is possible to supply the at least one tool mounted on the bottom part and the suction turbine in the suction unit with the same power supply. For this purpose, an energy storage device can be provided on the floor cleaning machine or a power cable for connection to an external power supply.

At least one energy storage device is advantageously mounted removably.

Because of this the weight of the floor cleaning machine can be reduced, if the floor cleaning machine, for example, is connected to an external power supply. This also permits changing of the energy storage device so that the operating time of the floor cleaning machine driven by the energy storage device mounted removably on the machine can be lengthened.

At least one energy storage device is advantageously mounted on the bottom part and/or guide part.

Depending on the design of the bottom part and the guide part it can be advantageous to mount the energy storage device on the bottom part and/or guide part in order to guarantee the easiest possible mobility of the bottom part by means of the guide part.

At least one energy storage device is advantageously provided on the separate suction unit and/or the separate suction unit is connected to the bottom part, the guide part or the handle via a power cable and/or control cable.

A power supply accommodated in the suction unit, which supplies both the suction turbine and the at least one tool for floor cleaning, has the advantage that its weight does not restrict the mobility of the bottom part by means of the guide part.

Supplying the suction turbine by means of a power supply mounted on the bottom part and/or guide part makes it possible to keep the suction unit light and its outside dimensions limited. When designed as an additional bottom unit, this increases the mobility of this additional bottom unit. When the suction unit is designed as a unit to be attached to the body the lower weight increases the wear comfort and the smaller dimensions increase handling capability.

If the power supply for the suction turbine is arranged on the suction unit and the power supply for the at least one tool is mounted on the bottom part or guide part, no power cable need be provided between the suction unit and bottom part, guide part or handle part.

The bottom part advantageously has a loosely suspended spray protection ring, which is movable vertically relative to the bottom part and which encloses the tool for floor cleaning at least in sections.

To avoid spray water a spray protection ring extending as far as possible or entirely around the tool for floor cleaning is advantageous. Owing to the fact that the spray protection is loosely suspended and is variable in height relative to the bottom part, this ensures that the spray protection ring always lies flat on the surface being cleaned independently of the movements of the bottom part and therefore avoids spray water.

A liquid tank for liquid feed is advantageously provided.

The advantage is that an external water supply need not be connected, in which case a corresponding hose would restrict the movement radius of the floor cleaning machine.

The liquid tank is advantageously mounted on the guide part.

This permits an advantageous compact form of the floor cleaning machine. If the container for the taken up liquid is also arranged on the guide part and/or bottom part in addition to the liquid tank, the total weight of the bottom part and guide part remains essentially constant so that a constant pressure on the tools carrying the bottom part can be ensured. This permits constant quality of cleaning by the tools for floor cleaning.

The liquid tank mounted on the guide part is advantageously shaped elongated along the guide part.

This has the advantage that the liquid situated in the liquid tank is always as close as possible to the guide part so that the weight of the liquid loads the guide part as little as possible even when the guide part is positioned obliquely, which facilitates handling.

If the container for the taken up liquid is also mounted elongated along the guide part in addition to the liquid tank, it can be possible to shape these two liquid containers the same so that more cost-effective production is made possible.

The liquid tank is advantageously accommodated in the separate suction unit.

Because of this the guide part has a lower weight, which enables the user to move the bottom part by means of the guide part with less exertion.

The tool for floor cleaning advantageously consists of at least two oppositely rotating, essential horizontal driving disks with cleaning accessories or of at least two oppositely rotating rollers with bristles.

The opposite rotation of two driving disks mounted symmetrically around the center of the floor cleaning machine leads to a force-neutral state of the bottom part with an even number of driving disks and permits easy, resistance-free guidability of the bottom part by means of the guide part over the floor. The same applies for the rollers.

The cleaning accessories can advantageously be brushes, disks for pads or buffing disks.

This has the advantage that the user requires only one floor cleaning machine in order to perform a variety of operations, namely scrubbing, polishing and buffing, in which fastening of the cleaning accessories should be possible by hand without an additional tool.

Liquid feed advantageously occurs in an area beneath the bottom part within the spray protection and/or in the center through the driving disks so that the most uniform possible distribution of liquid is made possible. The liquid receptacle advantageously has a squeegee with two sealing lips which extends at least over half the width and preferably over the entire width of the bottom part and is bent around the brushes across the direction of cleaning and is arranged behind the tool for floor cleaning when viewed in the movement direction, in which case the front sealing lip in the direction of movement is preferably corrugated or has openings.

The squeegee with the two sealing lips permits direct take-up of liquid. The farther the squeegee with the sealing lips extends around the tool for floor cleaning, the more liquid is already taken up in the first cleaning process. The corrugation or openings of the front sealing lip make it possible for the liquid to reach the area between the sealing lips and be drawn into the container for the taken up liquid by means of the partial vacuum generated by the suction unit.

The squeegee with the two lips for taking up liquid is advantageously mounted loosely and vertically movable relative to the bottom part.

Owing to the fact that the squeegee with the sealing lips is mounted freely variable in its height independently of the vertical movements of the bottom part, it can be guaranteed that the sealing lips always sit on the surface being cleaned so that efficient liquid take-up is made possible. If the spray protection is arranged correspondingly loose and independently of the vertical movements of the bottom part, it is possible, for example, to mount the squeegee with sealing lips on the spray protection. The guide part on the lower end beneath the center but above the bottom part advantageously has an additional articulation with another articulation axis running across the first articulation axis around which the guide part is adjustable across the direction of cleaning so that the bottom part can be rotated by at least ±45° by a user around a vertical axis of the bottom part parallel to surface being cleaned.

This additional articulation forms a cardan joint with the first articulation and enables the user to rotate the bottom part within the cleaning plane, even if the guide part is positioned obliquely around the first articulation axis relative to the vertical axis of the bottom part. This permits cleaning of corners or niches, for example.

The bottom part can advantageously be rotated by the user by at least ±270° around the vertical axis of the bottom part parallel to the surface being cleaned.

Thus, the user can rotate the cleaning direction of the floor cleaning machine by 270° even if the guide part is positioned obliquely around the first articulation axis relative to the vertical axis of the bottom part. This enables the user to first operate the floor cleaning machine in a direction pointing away from the user and then rotate the bottom part by 180° and move the floor cleaning machine back in a direction pointing toward the user. In addition, while he is moving forward, the user can also turn further and therefore also has complete mobility in the lateral direction even with movement of the bottom part directed toward the user. This mobility permits cleaning of corners, niches or protrusions, for example, under stairs or tables.

In addition, mobility permits cleaning both in the forward and backward direction and in the lateral direction, in which case the floor cleaning machine can always be moved in the cleaning direction, which represents a prerequisite for regular take-up of liquid.

The liquid tank for liquid feed and/or the container for the taken up liquid is advantageously mounted around the guide part above the additional articulation.

Because of this easy movement of the bottom part by means of a guide part is guaranteed.

The liquid feed, the at least one tool for floor cleaning and the suction unit of the floor cleaning machine are advantageously connected separately from each other and can be arbitrarily combined.

This permits the described floor cleaning machine to be used for a variety of work, for example, wet scrubbing, polishing or also buffing.

The invention also concerns a hand-guided floor cleaning machine, which has a bottom part with at least one tool for floor cleaning and a motor to drive the at least one tool, as well as a bracket that encloses the bottom part at least in sections and is connected to the bottom part via a first articulation adjustable in the cleaning direction with an articulation axis across the cleaning direction and the guide part with a handle mounted on the bracket. The guide part on its lower end beneath the center but above the bottom part has an additional articulation with an additional articulation axis running across the first articulation axis, around which the guide part is adjustable across the cleaning direction so that the bottom part can be rotated by the user by at least ±45° around a vertical axis of the bottom part parallel to the surface being cleaned.

The additional articulation forms with the first articulation a cardan joint and enables the user rotate the bottom part within the cleaning plane, even if the guide part is positioned obliquely to the vertical axis of the bottom part around the first articulation axis, which permits high mobility of the bottom part. The cleaning direction of the bottom part even with an obliquely positioned guide part is therefore pivotable parallel to the floor and permits simple cleaning of corners or niches or under protrusions.

In principle, any rotation of the bottom part around its vertical axis is possible with such a cardan joint even with the obliquely positioned guide part.

Advantageously, the bottom part can be rotated by the user by at least ±270° around the vertical axis of the bottom part parallel to the cleaning surface.

This enables the user to first operate the floor cleaning machine in a direction pointing away from the user, then rotate the bottom part by 180° and move the floor cleaning machine back in a direction pointing toward the user. The user can also further rotate the bottom part while he is moving it back toward him and therefore also has full mobility in the lateral direction even during movement of the bottom part directed toward the user. This mobility permits simple cleaning of corners, niches or protrusions, for example, under steps or tables. The mobility also permits cleaning both in the forward and backward directions and also in the lateral direction, even if the guide part is positioned obliquely around the first articulation axis relative to the vertical axis of the bottom part, in which case the floor cleaning machine can always be moved in the cleaning direction, which represents a prerequisite for regular take-up of liquid.

The bottom part is advantageously supported exclusively on the tool for floor cleaning. Because of this the mobility of the bottom part is not restricted by a support device.

Advantageously the tool for floor cleaning consists of at least two oppositely and essentially horizontally rotating driving disks with cleaning attachments or at least two oppositely rotating rollers with bristles.

The opposite positioning of two driving disks mounted symmetrically around the center of the floor cleaning machine leads to a force-neutral state of the bottom part with an even number of driving disks and permits easy, resistance-free guidability of the bottom part by means of the guide part over the floor. The same also applies for rollers.

The cleaning attachments can advantageously be brushes, disks for pads or buffing disks.

Because of this the floor cleaning machine can be used for a variety of operations, like polishing, scrubbing or buffing.

The floor cleaning machine advantageously has at least one energy storage device to supply the tool and/or a power cable to an external power supply.

By connecting the floor cleaning machine to an external power supply by means of a power cable unlimited operating time is possible. The weight of the bottom part can also be kept low on this account, which enables the user to easily move and guide the bottom part by means of the guide part. Through an energy storage device mounted on the floor cleaning machine the power cable to an external power supply can be dispensed with so that a higher motion radius of the floor cleaning machine is made possible. For example, this makes it possible to use the floor cleaning machine for cleaning of stairways.

The at least one energy storage device is advantageously mounted on the bottom part and/or on the guide part.

The at least one energy storage device is advantageously mounted removable.

Because of this the energy storage device can be changed and permits longer operating time. It is also possible on this account to remove the energy storage device and therefore the reduce the weight of the bottom part and/or the guide part, if the floor cleaning machine is connected, for example, to an external power supply so the bottom part can be moved and guided more easily by means of the guide part.

The bottom part advantageously has a loosely suspended spray protection movable vertically relative to the bottom part, which encloses the tool for floor cleaning at least in sections.

Through the loose vertically movable arrangement of the spray protection this can always sit flatly on the cleaning surface independently of movements of the bottom part and thus avoid spray water.

The bottom part advantageously has a liquid feed. Because of this the floor cleaning machine can also be used for wet scrubbing.

The liquid feed advantageously occurs in an area beneath the bottom part within the spray protection and/or in the middle through the driving disks and the cleaning attachment. This guarantees uniform flat distribution of the liquid.

A liquid tank is advantageously provided for the liquid feed. Because of this the floor cleaning machine need not be connected to an external water supply, which would restrict the movement radius of the floor cleaning machine.

The liquid tank is advantageously mounted on the bottom part or on the guide part above the additional articulation. Because of this the mobility of the bottom part is restricted as little as possible by the guide part.

Advantageously the liquid tank mounted on the guide part is shaped elongated along the guide part. Because of this the liquid is situated as close as possible to the guide part so that the weight of the liquid hampers movement of the guide part as little as possible.

The floor cleaning machine advantageously has a liquid receptacle and a separate suction unit, which contains at least one suction turbine to take up the liquid.

By separation of the suction unit the weight of the bottom part and the guide part can be kept low so that the bottom part can be easily moved and guided by the guide part.

A container for the taken up liquid is advantageously arranged on the bottom part and/or guide part and connected to the separate suction unit via a hose.

By separation of the container for the taken up liquid from the suction turbine it can be ensured in a simple manner that the suction turbine does not come in contact with liquid.

The provision of the container for the taken up liquid on the bottom part also has the advantage that the path for the water being taken up from the floor into the container for the taken up liquid is as short as possible so that the effective suction power of the suction turbine is increased.

The container for the taken up liquid is advantageously mounted on the guide part above the additional articulation and shaped elongated along the guide part.

Because of this the mobility of the bottom part permitted by the two articulations is not restricted and the mobility of a guide part is loaded as little as possible by the weight of the taken up liquid.

The separation suction unit advantageously has a container for the taken up liquid. Because of this the bottom part or the guide part is not hampered by the weight of the taken up liquid, which permits easier guidability.

The suction unit is advantageously designed as an additional bottom unit. Since a bottom unit need not be particularly small in order to pull it easily, for example, on wheels and not particularly hamper the user in his work, an additional bottom unit, which can be pulled, for example, by means of a traction device behind the floor cleaning machine, can be simply and cost-effectively implemented.

The suction unit is advantageously designed as a unit to be attached to the body of the user. Such a unit to be attached to the body only slightly restricts the user in his freedom of motion and simultaneously permits easy mobility of the bottom part by means of a guide part owing to the lower weight of the bottom part and the guide part. Depending on the weight and dimensions of the unit to be attached to the body, it can be designed so that it is worn either on the back, around the hips or in front of the stomach.

The unit to be attached to the body is advantageously provided with a support frame. Because of this the weight of the suction unit can be comfortably worn by the user on the body. For example, a backpack-like support frame can be provided so that the suction unit can be worn on the back.

The container for the taken up liquid is advantageously arranged in the unit to be attached to the body and has an outlet opening and an outlet connector connected to the outlet opening or an outlet hose with closure.

Because of this the bottom part and the guide part are not hampered by the weight of the taken up liquid. The closure of the outlet connector or the outlet hose should be configured as simple as possible so that the dirt contained in the taken up liquid does not adversely affect the sealing capability of the closure. A large cover can also be provided, which permits emptying and also simple cleaning of the container for the taken up liquid.

The outlet opening is advantageously arranged in the bottom area, the outlet connector or outlet hose with the closure being arranged so that it is possible for the user to discharge the taken up liquid while he is wearing the unit to be attached to the body.

If the suction unit is formed as a unit to be attached to the body, discharge of the taken up liquid while still wearing the unit to be attached to the body has the advantage that later removal is not hampered by the additional weight of the taken up liquid.

Advantageously the liquid receptacle has a squeegee with two sealing lips, which extends at least over the half the width, preferably over the entire width of the bottom part and is bend around the tool for floor cleaning across the direction of cleaning and, viewed in the direction of cleaning is arranged behind the tool for floor cleaning, in which case the front sealing lip in the movement direction is preferably corrugated or has openings.

The squeegee with the sealing lips permits direct take-up of liquid. The farther the squeegee with the sealing lips extends around the tool for floor cleaning, the more liquid is already taken up in the first cleaning process. The corrugation or openings of the front sealing lip make is possible for liquid to reach the area of the squeegee between the sealing lips and be taken up there.

Advantageously, the squeegee with the sealing lips of the liquid receptacle is mounted loosely and vertically movable relative to the bottom part.

Owing to the fact that the squeegee with the sealing lips is mounted independently of the vertical movements of the bottom part, it can be guaranteed that the sealing lips always sit on the surface being cleaned so that efficient liquid take-up is made possible. If the spray protection is arranged correspondingly loose and independent relative to the vertical movement of the bottom part, it is possible, for example, to mount the squeegee with sealing lips on the spray protection.

The liquid tank is advantageously mounted on a separate suction unit. Because of this the weight of the bottom part and/or the design part can be kept low, which guarantees easier mobility of these parts.

The liquid feed, the tools for floor cleaning and the separately designed suction unit of the floor cleaning machine are advantageously connected separately from each other and can be combined arbitrarily. Because of this it is possible to use the described floor cleaning machine for a variety of work, for example, light scrubbing, polishing or even buffing.

Advantageously the separate suction unit has an energy storage device and a switch to supply the suction turbine and/or the tool and/or is connected to the bottom part, the guide part or the handle part via a power and control cable.

BRIEF DESCRIPTION OF THE DRAWING

A practical example of the invention is shown in the drawing. In the drawing

PRACTICAL EXAMPLE

Figure 1:
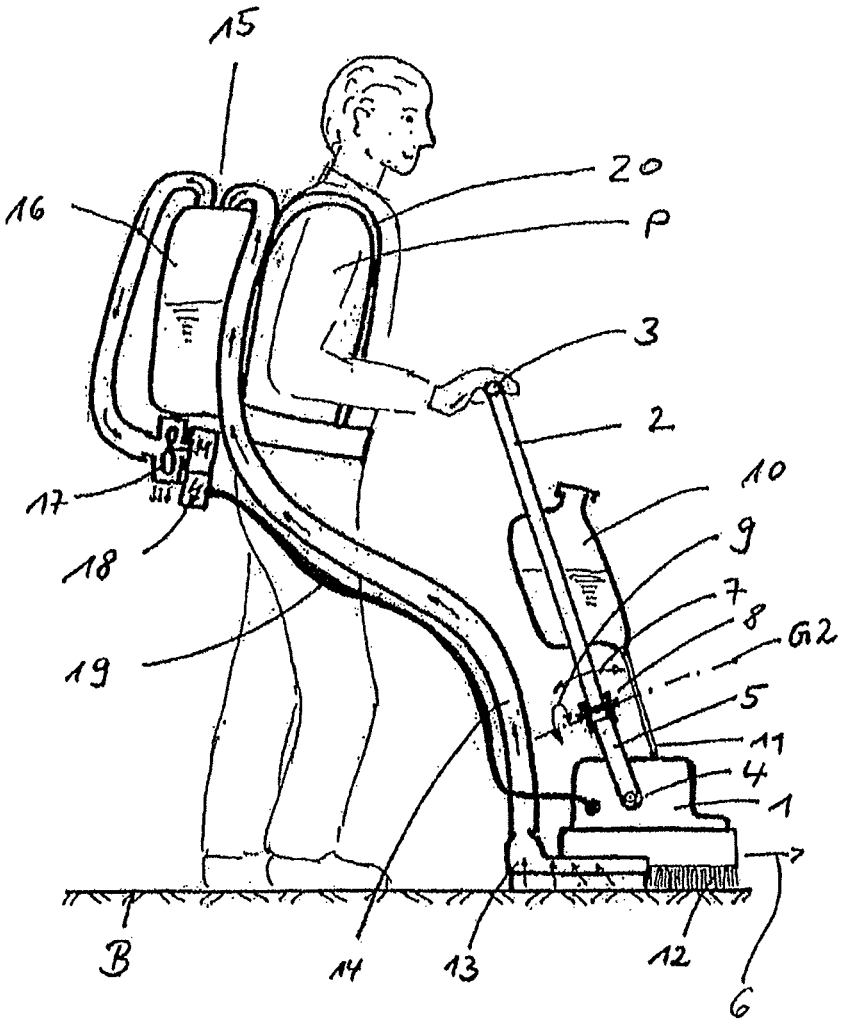
FIG. 1 shows a hand-guided floor cleaning machine with a suction unit designed as a unit to be attached to the body.
Figure 3:
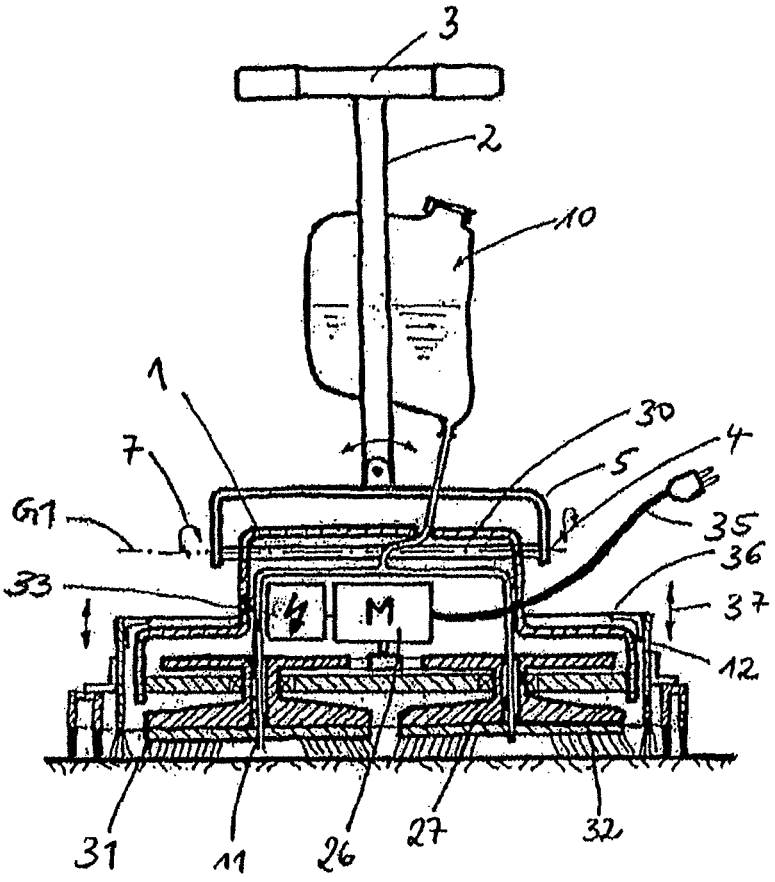
FIG. 3 shows a cross section of the bottom part with guide part and handle part of the floor cleaning machine from FIG. 1.

A floor cleaning machine according to the invention is depicted in FIG. 1. A bottom part 1 can be guided via a guide part 2 and a handle part 3 by a user P, in which case the guide part 2 is connected to the bottom part 1 via two articulations, which together form a cardan joint. A first articulation 4 consists of a bracket 5 and an axis 30 mounted on bottom part 1 depicted in FIG. 3, in which an articulation axis G1, which is shown in FIG. 3, runs along the axis 30 parallel to a cleaning surface 30 parallel to a cleaning surface B and across the cleaning direction 6 and the bracket 5 can be moved around axis G1 according to the direction indicated by arrow 7. A second articulation 8 connects the guide part 2 to bracket 5, in which an articulation axis G2 runs across the articulation axis G1 and the guide part can be moved around axis G2 according to the direction indicated by arrow 9. This enable the user P to rotate the bottom part 1 around its vertical axis A1 parallel to the cleaning surface B even when guide part 2 is obliquely positioned. The user P can therefore rotate the cleaning direction 6 parallel to the cleaning surface B. The user P can first move the bottom part, for example, away from him and then toward him after rotating the bottom part by 180°, in which case the cleaning direction 6 first runs away from him and then toward him accordingly.

The floor cleaning machine according to the invention has a liquid tank 10 for liquid feed, which can be mounted, for example, above the second articulation 8 on guide part 2 and is connected to the bottom part 1 via a liquid feed 11. It is advantageous in the depicted variant to configure the liquid tank 10 so that it extends at least partially around guide part 2 and its dimensions in the direction across guide part 2 are as limited as possible, whereas the dimensions along guide part 2 can be greater. Movement of the guide part 2 is hampered as little as possible on this account by the liquid also moving in liquid tank 10.

The floor cleaning machine has a spray protection 12, which is arranged on the outside of bottom part 1 and extends as far as possible around bottom part 1. The spray protection 12 faces toward cleaning surface B with bristles or lips and is arranged so that it is vertically movable relative to bottom part 1 over the cleaning surface B so that it sits with its bristles or lips always on the cleaning surface B.

The bottom part 2 also has a liquid receptacle 3 on its bottom, which extends as far as possible over the width of bottom part 1 across the cleaning direction 6 and is arranged behind bottom part 1 in the movement direction 6 and fastened to spray protection 12 without restricting the free vertical mobility of the spray protection 12 relative to bottom part 1.

The separate suction unit is designed in the depicted variant as a unit 15 to be fastened to the body by a user P. This user 15 to be fastened to the body is also designed as a backpack unit and connected to the liquid receptacle 13 via a hose 14. The backpack unit 15 has a container 16 for the liquid taken up from the floor surface B and a suction turbine 17, which can be driven with a motor 18, which is also arranged in the backpack unit 15. For power supply the motor 18 is directly connected to bottom part 1 via a power and optionally control cable 19, in which a connection can be provided on the backpack part 15 or on the bottom part 1 so that this connection between the backpack part 15 and bottom part 1 can be released.

In another variant the power and control table 19 can also be guided over the handle part 3 and/or guide part to bottom part 1 or a connection can be provided on the handle part 3 or guide part 2 to which the power control cable 19 can be connected.

It can also be advantageous to arrange the container 16 for the liquid taken up from the floor surface B on guide part 2 and connected via hose to the liquid receptacle 13 and suction turbine 17 so that a very short suction path is possible so that effective suction power of the suction turbine 17 is approved. Here it is advantageous to form the container 16 for the taken up liquid elongated along the guide part 2 so that the taken up liquid is always situated as close as possible to guide part 2 and the mobility of the guide part 2 is not needlessly loaded by the weight of the taken up liquid on this account.

Owing to the fact that both the liquid tank for the liquid feed and the container 16 of the taken up liquid are arranged on the guide part 2 and/or on bottom part 1, the total weight of the bottom unit from bottom part 1 and guide part 2 remains essentially constant during floor cleaning. This makes it possible to keep the pressure on the at least one tool 31 for floor cleaning constant and thus guarantee a constant and reliable function.

It is also possible to shape the container for the taken up liquid and the liquid tank for the liquid feed the same, i.e., to choose only one shape for both containers so that the production costs of the floor cleaning machine can be reduced.

The provision of container 16 for the taken up liquid on bottom part 1 and/or guide part 2 also has the advantage that during loosening of the hose, which connected the container 16 of the taken up liquid to suction turbine 17, no residual liquid remaining in the hose can run out, since the liquid remains in the deeper lying container 16 for the taken up liquid.

The backpack unit 15 has a support frame 20 so that it can be comfortably worn on the back by user P.

For other variants of the unit 15 to be fastened to the body support frames adapted to the type of wearing can be provided accordingly and the shape of the unit to be fastened to the body can also be adapted to the type of wearing. The backpack unit, for example, can be designed flat and elongated and provided with a backpack-like support frame. If the unit to be fastened to the body is to be worn around the hips, it must be designed correspondingly smaller and provided with a hip belt. A unit to be fastened in front of the stomach, for example, can be designed not as long as is possible in a backpack unit.

Figure 2:
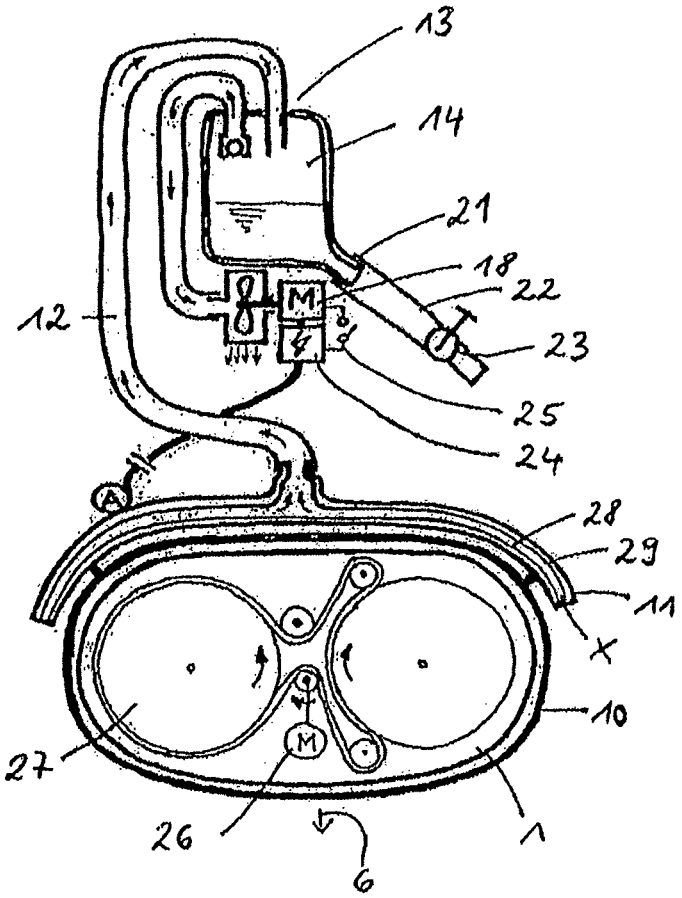
FIG. 2 shows a detailed view of a bottom part and a unit of the floor cleaning machine to be attached to the body from FIG. 1.

The backpack unit from FIG. 1 is shown in cross section in FIG. 2. The container 16 for the taken up liquid has an outlet opening 21 in the bottom area, on which an outlet hose 22 or also an outlet connector with a closure 23 is mounted. The outlet hose 22 and/or closure 23 are arranged so that the blocking fitting 23 can be operated by user P and the taken up liquid can be discharged from the container 16 for the taken up liquid via discharge hose 22, while the user P is wearing the backpack unit 15 on the back. In order to increase the movement freedom of the user P during discharge of the taken up liquid, a connection with a coupling can be provided for hose 14 so that this connection of the backpack unit 15 to bottom part 1 can be released. As an alternative, a connector can be provided on the bottom part 1. The hose or connector on the bottom part can also be designed as a siphon, which prevents residual water from emerging.

The backpack unit 15 in this variant has a power supply 24 for a motor 18 and a switch 25 for switching on and switching off the suction turbine 17.

The bottom part 1 of the floor cleaning machine according to the invention is depicted in FIG. 2 from below without a cleaning attachment. Two driving disks 27 are driven oppositely by a motor 26 essentially horizontally. The liquid receptacle 13 is mounted on the spray protection 12, which in this variant extends in annular fashion around the entire bottom part 1 so that free movement of the spray protection 12 in its height over the cleaning surface relative to bottom part I is not adversely affected. The liquid receptacle 13 has a squeegee 49 with two sealing lips 28, 29 spaced from each other in the cleaning direction 6, in which the front lip 28 is corrugated, if possible, in the cleaning direction 6 or has openings through which the liquid being taken up can reach the area x between the two sealing lips 28, 29 during movement of bottom part 1 in the cleaning direction 6. This area x of the squeegee 49 between sealing lips 28, 29 is connected to the suction unit designed as a backpack unit 15 via hose 14 so that liquid can be taken up.

FIG. 3 shows a cross section of bottom part 1 and guide part 2 and handle part 3 of the floor cleaning machine from FIG. 1. The articulation 4, which consists of bracket 5 and axis 30, which is fastened to bottom part 1, is again shown, in which the articulation 4 can be moved around the articulation axis G1 according to the direction depicted by arrow 7.

The bottom part 1 also has a tool 31 for floor cleaning, which includes the driving disk 27 and cleaning attachments 32, like the depicted brushes, in which the bottom part 1 is supported exclusively on tool 31. The cleaning attachments 32 arranged on driving disks 27 are driven with motor 26, which is supplied by an energy storage device 33. This energy storage device 33 is fastened, if possible, removably on bottom part 1 and can be charged, for example, via a power cable. Motor 26, if possible, also has a power cable 35, which makes it possible to dispense with the energy storage device 33 and to connect motor 26 to an external power supply.

The liquid feed 11 for liquid from the liquid tank 10 occurs in the center through driving disks 27. The spray protection 12 can be loosely connected to the bottom part 1 with at least one bracket 36 extending over bottom part 1 so that it is freely movable vertically during operation, i.e., in the direction of arrow 37, but remains connected to bottom part 1 during lifting of bottom part 1 above the at least one bracket 36. Because of this the user P can simultaneously lift the bottom part 1 and spray protection 12 and move them and need not additionally move the spray protection 12.

The energy storage device to supply the motor that drives the suction turbine can also be arranged on the guide part, in which case the energy storage device is advantageously mounted within the tank 19 but above articulation 8.

Figure 4A:
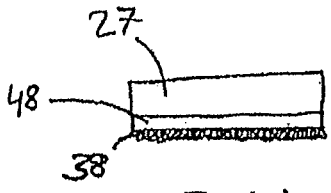
FIG. 4 shows different variants of a tool for floor cleaning of the floor cleaning machine from FIG. 1, FIG. 5 A, B shows a view of the mobility of the bottom part of the floor cleaning machine from FIG. 4.
Figure 4B:
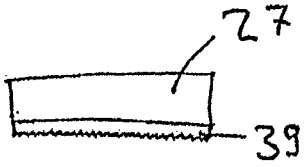
Figure 4:
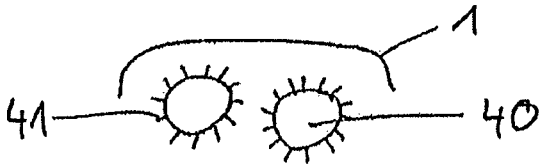

Additional variants of tool 31 for floor cleaning are shown in FIG. 4. FIG. 4A shows a drive disk 27 with a cleaning attachment 32 in the form of a disk 48 for pads 38 and FIG. 4B shows a drive disk 26 with a buffing disk 39 as cleaning attachment. FIG. 4C shows a bottom part 1 of a floor cleaning machine according to the invention, which has on its bottom rollers 40 with bristles 41 as tool 32 for floor cleaning.

Figure 5A:
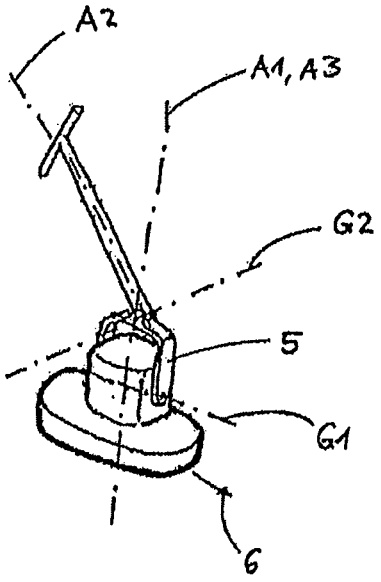
Figure 5B:
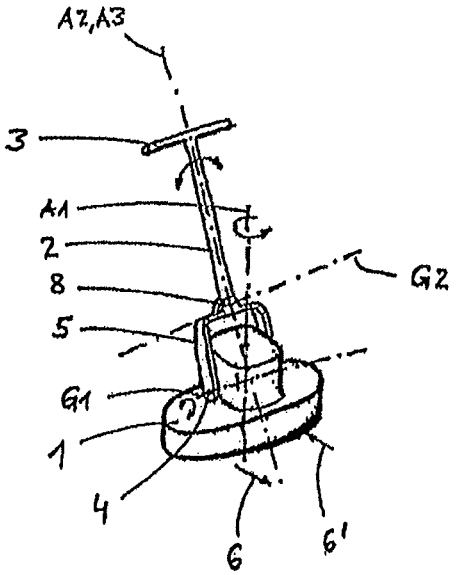

FIGS. 5A, B shows how the bottom part 1 of the floor cleaning machine according to the invention can be rotated by means of articulations 4 and 8 around the vertical axis A1 of the bottom part 1, which is essentially vertical on the cleaning surface B, when the guide part 2 is positioned obliquely. By rotating the handle part 3 by 90° around a longitudinal axis A2 of guide part 2 the bottom part is also rotated by 90° around the vertical axis A1, in which case the bracket 5 is then brought from an initial oblique position opposite the first cleaning direction 6 around axis G1 into a position parallel to axis A1 and the guide part 2 is moved around the additional articulation axis G2 from an initial alignment parallel to a longitudinal axis A3 of bracket 5 into an alignment oblique relative to longitudinal axis A3 of bracket 5. From this position depicted in FIG. 5B the bottom part 1 can also be rotated another 90° by rotating the handle part 3 another 90° so that the cleaning direction 6, which originally points in the direction away from the user P, is now directed toward user P according to the direction shown by arrow 6'.

Figure 6:
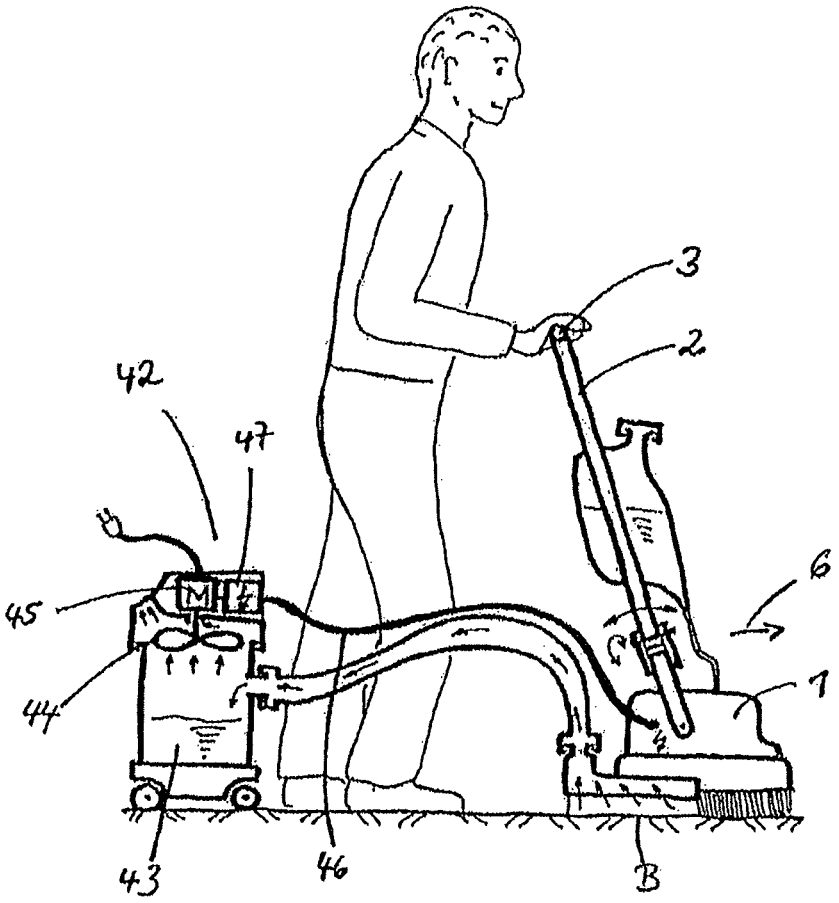
FIG. 6 shows a hand-guided floor cleaning machine with a suction unit designed as an additional bottom unit.

FIG. 6 shows a floor cleaning machine according to the invention as depicted in FIG. 1, with the difference that the separate suction unit is designed as an initial bottom unit 42. The bottom unit 42 has a container 43 for the liquid taken up from the floor surface B, as well as a suction turbine 44, which can be driven with a motor 45, which is also arranged in the bottom unit 42. For a power supply the motor 42 is connected via a power and optionally control cable 46 directly to bottom part 1, in which case a connection can be provided on bottom unit 42, bottom part 1, guide part 2 or handle part 3 so that this connection can be released between bottom unit 42 and bottom part 1.

In another variant the power and/or control cable 46 can also be guided over the handle part 3 and/or the guide part to the bottom part 1 or a connection can be provided on the handle part or on guide part 2 to which the power and/or control cable 46 can be connected.

As an alternative the bottom unit 42 can also have a power cable that makes it possible to connect motor 45 to an external power supply. The bottom unit 42 can have as further alternative its own energy storage device 47 from power supply of motor 45.

LIST OF REFERENCE NUMBERS

1 Bottom part
2 Guide part
3 Handle part
4 First articulation
5 Bracket
6 Cleaning direction
6' Cleaning direction after rotation of the floor cleaning machine
7 Movement direction of the first articulation 4
8 Second articulation
9 Movement direction of the second articulation 8
10 Liquid tank
11 Liquid feed
12 Spray protection
13 Liquid receptacle
14 Hose
15 Unit to be fastened to the body
16 Container for the taken up liquid
17 Suction turbine
18 Motor to drive the suction turbine 17
19 Power and/or control cable
20 Support frame
21 Outlet opening
22 Outlet hose
23 Closure
24 Energy storage device
25 Switch
26 Motor to drive the tool for floor cleaning
27 Driving disk
28 Sealing lip of squeegee 49 corrugated or with openings
29 Sealing lip for squeegee 49
30 Axis
31 Tool for floor cleaning
32 Cleaning attachment
33 Energy storage device
34 Power cable
36 Bracket
37 Movement direction of spray protection 12
38 Pad
39 Buffing disk
40 Roller
41 Bristles
42 Additional bottom unit
43 Container for taken up liquid
44 Suction turbine
45 Motor
46 Power and/or control cable
47 Energy storage device
48 Disk for pad
49 Squeegee
A1 Vertical axis of bottom part 1
A2 Longitudinal axis of guide part 2
A3 Longitudinal axis of bracket 5
B Cleaning surface
G1 Articulation axis of first articulation 4
G2 Articulation axis of second articulation 8
P User
x Area between sealing lips 28 and 29

The invention claimed is:

1. A hand-guided floor cleaning machine, having a bottom part (1) with at least one tool (31) for floor cleaning and a motor (26) to drive at least one tool (31) and having a guide part (2) with a handle part (3), in which the guide part (2) is connected to the bottom part (1) via a first articulation (4) adjustable in a cleaning direction (6) with an articulation axis (G1) across the cleaning direction (6), characterized in that the bottom part (1) has a liquid feed (11) and a liquid receptacle (13) and that a suction unit structurally separate from the bottom part is provided, which contains at least one suction turbine (17), and in that the guide part (2) has an additional articulation (8) with an additional articulation axis (G2) running across the first articulation axis (G1) on the lower end beneath the center but above the bottom part (1), around which the guide part (2) is adjustable across the cleaning direction (6) such that the bottom part (1) can be rotated by at least ±45° by a user (P) around a vertical axis (A1) of bottom part (1) parallel to cleaning surface (B), and further characterized in that the liquid receptacle (13) has a squeegee (49) with two sealing lips (28, 29), which extends over at least half the width, preferably over the entire width of the bottom part (1) and is bent around tool (31) for floor cleaning across the cleaning direction (6), and is arranged behind the tool (31) for floor cleaning viewed in the direction (6) of movement, where the sealing lip (28) located in front in the movement direction (6) is preferably corrugated or has openings.

2. The hand-guided floor cleaning machine of claim 1, characterized in that the bottom part can be rotated by at least ±270° by user (P) by means of the guide part (2) around the vertical axis (A1) parallel to cleaning surface (B).

3. The hand-guided floor cleaning machine of claim 1, characterized in that a liquid tank (10) for liquid feed (11) and/or a container (16) for the taken up liquid is mounted around guide part (2) above the additional articulation (8).

4. The hand-guided floor cleaning machine of claim 1, characterized in that the liquid feed (11), the tools (31) for floor cleaning and the suction unit structurally separate from the bottom part (1) of the floor cleaning machine are adapted to be activated selectively and independently and can be combined in an arbitrary manner.

5. The hand-guided floor cleaning machine of claim 4, characterized in that container (16) for the taken up liquid and/or liquid tank (10) mounted on the guide part (2) are formed elongated along the guide part (2).

6. The hand-guided floor cleaning machine of claim 1, characterized in that the bottom part (1) is exclusively supported on the tool (31) for floor cleaning.

7. The hand-guided floor cleaning machine of claim 1, characterized in that the floor cleaning machine has at least one energy storage device (24, 33) and/or a power cable (35) to an external power supply to supply at least one tool (31) for floor cleaning and/or suction turbine (17).

8. The hand-guided floor cleaning machine of claim 7, characterized in that at least one energy storage device (24, 33) is mounted to be removable.

9. The hand-guided floor cleaning machine of claim 7, characterized in that at least one energy storage device (33) is mounted i) on the bottom part (1), ii) on the guide part (2), or iii) on the bottom part (1) and on the guide part (2).

10. The hand-guided floor cleaning machine of claim 7, characterized in that the suction unit structurally separate from the bottom part (1) is connected to the bottom part (1) or to the handle part (3) via i) a power cable, ii) a control cable, or iii) a power cable and a control cable.

11. The hand-guided floor cleaning machine of claim 1, characterized in that the bottom part (1) has a loosely suspended spray protection (12) movable vertically relative to bottom part (1), which encloses tool (31) for floor cleaning at least in sections.

12. The hand-guided floor cleaning machine of claim 1, characterized in that a liquid tank (10) for liquid feed (11) is provided.

13. The hand-guided floor cleaning machine of claim 12, characterized in that liquid tank (10) is mounted on the guide part (2).

14. The hand-guided floor cleaning machine of claim 13, characterized in that liquid tank (10) mounted on the guide part (2) is formed elongated along the guide part (2).

15. The hand-guided floor cleaning machine of claim 1, characterized in that the tool (31) for floor cleaning is composed of at least two oppositely and essentially horizontally rotating driving disks (27) with cleaning attachments (32) or at least two oppositely rotating rollers (40) with bristles (41).

16. The hand-guided floor cleaning machine of claim 15, characterized in that the cleaning attachments (32) may be brushes, retainers for pads (38) or buffing disks (39).

17. The hand-guided floor cleaning machine of claim 15, characterized in that the liquid feed (11) occurs in an area i) beneath the bottom part (1) within spray protection (12), ii) in the center through the driving disks (27), or iii) beneath the bottom part (1) within spray protection (12) and in the center through the driving disks.

18. The hand-guided floor cleaning machine of claim 1, characterized in that the squeegee (49) with the two sealing lips (28, 29) of the liquid receptacle (13) is loosely arranged and movable vertically relative to the bottom part (1).

* * * * *